US006253395B1

(12) United States Patent
Quam

(10) Patent No.: US 6,253,395 B1
(45) Date of Patent: Jul. 3, 2001

(54) SPLASH GUARD

(76) Inventor: Cindy M. Quam, 324 SW. 5th St., Brainerd, MN (US) 56401

( * ) Notice: Subject to any disclaimer, the term of this patent is extended or adjusted under 35 U.S.C. 154(b) by 0 days.

(21) Appl. No.: 09/587,772

(22) Filed: Jun. 6, 2000

(51) Int. Cl.[7] ..... E03C 1/181
(52) U.S. Cl. ..... 4/658; 4/300.3
(58) Field of Search ..... 4/658, 300.3

(56) References Cited

U.S. PATENT DOCUMENTS

| | | | | |
|---|---|---|---|---|
| 562,459 | * | 6/1896 | Davis | 4/658 X |
| 622,595 | | 4/1899 | Boehringer . | |
| 685,341 | | 10/1901 | McHale . | |
| 1,225,256 | | 5/1917 | Lambrix . | |
| 1,302,658 | | 5/1919 | Henning . | |
| 1,355,086 | | 10/1920 | Beebe . | |
| 1,408,812 | * | 3/1922 | Leighton | 4/658 |
| 1,579,374 | * | 4/1926 | Leighton | 4/658 |
| 1,618,032 | | 2/1927 | Wilkes . | |
| 2,508,808 | * | 5/1950 | Warman | 4/658 |
| 4,722,103 | * | 2/1988 | Kliebert | 4/658 |
| 5,012,537 | * | 5/1991 | Underwood | 4/658 |
| 5,625,910 | * | 5/1997 | Erickson et al. | 4/658 |

* cited by examiner

*Primary Examiner*—Charles E. Phillips
(74) *Attorney, Agent, or Firm*—Albert W. Watkins

(57) ABSTRACT

A sink or wash-basin guard provides an elevated barrier between a person and a cleaning liquid. The guard is attached to the sink with suction cups, and is readily removed and replaced. Cut-out portions are provided around which a person can easily reach, while not sacrificing the benefits associated with a greater height sink edge. The splash guard is also configured to provide support for a person's arms to rest upon, while using the sink. The armrest finds particular application with those persons who have been injured or have back problems, the elderly, and others with physical limitations, and also for those situations such as in commercial kitchens where a person will need to spend extended periods at the sink. An extension is provided which will accommodate sinks of various depths and persons of diverse heights, and the material selected for the guard, extension and suction cups is most preferably both durable and resilient. In the most preferred embodiment, the guard and extension are attached through the suction cups. In an alternative embodiment, an armrest is molded or formed integrally with the guard.

17 Claims, 3 Drawing Sheets

SPLASH GUARD

BACKGROUND OF THE INVENTION

1. Field of the Invention

This invention pertains generally to sinks, and more specifically to a wash receptacle splash guard having arm supports in association with an elevated splash guard. In accord with the invention, an adjustable section may also be provided, to accommodate a wide variety of sinks and basins.

2. Description of the Related Art

Modern conveniences save many people time. Nevertheless, there are always limitations inherent in machines, no matter how well designed. There are also situations that are not readily addressed by mass-produced equipment or machines. Consequently, there continues to be a need for human alternatives. This is true of dishwashing as well, which is done by hand by many people. While dishwashers serve many medium-sized families, larger pots and pans do not utilize space within the dishwasher well. Furthermore, pots and pans can be difficult or impossible to completely clean within the dishwasher, depending upon the foods that were prepared and the cooking techniques used. Consequently, many persons will still fill a sink with warm, soapy water either during or after cooking to clean these more difficult dishes. Also, smaller households with only one or two persons will not generate enough dishes to fill a dishwasher even through several meals, making the dishwasher a warm storage area which can be unpleasant and potentially unsanitary between washes. So, in many households, washing dishes by hand still remains the most appropriate method of cleaning dishes, pots and pans.

Other circumstances may prevent application of a machine such as a dishwasher. For example, many countries do not have an infrastructure or economics to support machines. This may be due to a lack of suitable power source, or may be due to less financial capability to purchase and operate the machine on the part of individuals within a particular geographic region. In yet other instances, many areas have inadequate water supplies that may prohibit the use of a dishwasher.

In addition to dishwashing, other chores will also require the use of a sink or basin of water. Cleaning and preparing foods, particularly such as carrots and potatoes, various laundering chores, and other such activities will require a person to work from the sink or basin. Commercial or industrial chores may also require a person to work within a sink or basin of one form or another. Commercial establishments from hospitals to restaurants and even including such diverse businesses as auto repair shops will use basins or sinks with various liquids or cleaning solvents for cleaning or other processes.

Unfortunately, particularly with liquids of low viscosity including water or soapy water, the processes used in the sink or basin may sometimes result in splashing or spraying of the liquid. This may be particularly true where various cleaning brushes are used, since the brush bristles will tend to flex or snap when coming off of a surface. This motion is generally beneficial to the removal of dirt or other contaminants from the surface. Unfortunately, the dirt may then be propelled by the bristle for quite some distance. Vegetable and potato brushes, bottle brushes and other similar type of cleaning tools are frequently associated with a flinging of contaminated cleaning solution. Splashing of water during spraying or rinsing of items within a sink or basin, or the occasional dropped item will also lead to undesirable splashing, as will more aggressive cleaning techniques and other events.

The splashing of cleaning liquids can present special problems, depending upon the particular liquid and the item being cleaned or processed within the sink or basin. In a commercial restaurant or food establishment, a person may spend many hours at the sink each day washing dishes. The person all too often will be leaning forward over or sideways against the sink supporting pots, pans or other dishes and utensils during scrubbing, washing and rinsing. This can be physically demanding, since the extension of the person's arms forward over the sink for extended periods will place a great deal of stress upon the person's arms, shoulders and back. This type of strain is detrimental, and will prevent some otherwise suitable people from being able to continue working in this type of job. Furthermore, during the course of a work shift, a large quantity of water may undesirably be sprayed beyond the sink onto the person, making the worker much less comfortable. Where particularly messy dishes or pans are being cleaned, this may also result in the staining or messing of the worker's clothing, which is also undesirable. However, the sink cannot simply be made deeper or with higher walls, since the person must still be able to reach into the sink and down to the bottom. Furthermore, there are occasional items that must be cleaned within the sink that are too large even to fit therein, and a sink which had higher walls would not accommodate these over-sized items.

In a hospital environment, where bio-hazardous or staining liquids may be processed through a sink, containment within the sink will be highly desirable. In this environment, the splash guard will most preferably shed liquid without adverse reaction or retention, and will provide an ample shield for the user to reduce or eliminate the need for additional precautionary measures such as clothes changes or extensive post-handling sterilization techniques.

In an industrial environment, various solvents may be used that will also most preferably be contained within the sink for later re-use or safe disposal. As with the other applications for the present invention, brushes and other cleaning tools will frequently be used. The mess created by using brushes and special tools will also most desirably be contained within a sink or basin.

Several patents in the prior art have attempted to address some of the problems that are solved by the present invention. For example, Warman in U.S. Pat. No. 2,508,808 illustrates an anti-splash shield that combines a number of suction cups with a flexible sheet plastic material. Most desirably, the Warman anti-splash shield provides an elevated lip about a sink or wash basin that effectively deepens the sink, while still allowing a person the flexibility to remove the shield when appropriate. Unfortunately, the Warman invention provides no support for a person's arms. In contrast to the present invention, this then requires the person to reach higher over the guard than would have been necessary with the sink alone, and also deeper to get into the bottom of the sink or basin. This, unfortunately, compounds the fatigue experienced by workers such as dishwashers, who spend many hours each day reaching down and forward to support the items being washed.

A number of other splash guards are illustrated, including U.S. Pat. No. 562,459 to Davis; U.S. Pat. No. 622,595 to Boehringer; U.S. Pat. No. 685,341 to McHale; U.S. Pat. No. 1,225,256 to Lambrix; U.S. Pat. No. 1,302,658 to Henning; U.S. Pat. No. 1,355,086 to Beebe; U.S. Pat. No. 1,408,812 to Leighton; U.S. Pat. No. 1,618,032 to Wilkes; and U.S. Pat. No. 5,625,910 to Erickson et al. These additional documents also provide splash protection, and illustrate various geometries and methods of attachment to wash basins and sinks. Nevertheless, in the prior art there still exists a need for a splash guard that provides workers relief from burdensome physical positioning and which also overcomes other limitations of the prior art.

SUMMARY OF THE INVENTION

In a first manifestation, the invention is a device for increasing the vertical extension of receptacle walls. The device acts as a shield for the person from exposure to materials within the receptacle, while also allowing the person to reach around to comfortably work for extended periods of time without the usually associated strain and fatigue. The device has a central elevated bib which acts as a torso shield by extending vertically beyond the receptacle walls. A side is lower than the central elevated bib, above which the person may reach while maintaining the bib between them and the receptacle. An armrest provides support for the person's arm above the side and around the central elevated bib.

In a second manifestation, the invention is an adjustable apparatus for elevating an edge of a sink, basin or the like and thereby assisting with the retention of liquids and other materials therein. A splash guard defines an apron elevated above the sink edge and a surface extending downward to a base. An extension engages the sink and extends in an vertical direction. A means is provided for adjustably attaching the splash guard to the extension, for varying an elevation of the splash guard relative to the sink.

In a third manifestation, the invention is a polymeric sheet forming a splash guard for wrapping inside the vertical wall about a basin and extending vertically. The sheet has a generally rectangular, planar base having a bottom, two side walls and a top, and a central region along the top. A planar tab is adjacent the top and forms a raised portion from the base vertically. Left and right downward slopes extend from either side of the central raised tab, each sloping downwards away. Left and right armrests are adjacent the downward slopes and the base sidewalls, and are also distal from the central raised tab. The combination of base, central raised tab, right and left downward slopes, and right and left armrests may be wrapped inside a basin vertical wall to form a three-dimensional structure, thereby enhancing retention of materials within the basin while simultaneously providing a human armrest.

Various features and alternatives are further provided with respect to each of the manifestations of the invention.

OBJECTS OF THE INVENTION

A first object of the invention is to improve containment of liquids and solvents within a sink or basin. A second object of the invention is to accommodate sinks and basins of widely differing geometries. A third object of the invention is to provide ready attachment and support of the invention within diverse sinks, and simple removal therefrom. A further object of the invention is to provide support to a person's forearms during use of the sink or basin, thereby alleviating significant stress upon the arms, shoulders and back. Another object of the invention is to provide adjustability to accommodate both persons and sinks or basins of differing heights. Yet a further object of the invention is to provide an aid or physical support to boost posture and thereby prop a person in a more nearly upright position. Another object of the invention is manufacture using low-cost materials and processes that are amenable to high volume production. Yet another object of the invention is to provide a vehicle for carrying an advertising logo or slogan which can be used to promote products or manufacturers' brand names in commercial, industrial, consumer or other markets. A further object of the invention is to withstand diverse liquids and solvents, where possible or required, thereby expanding the possible number of applications for the invention. Another object of the invention is to provide a liner for sinks and basins that provides resilience. These and other objects of the invention will be better understood by a review of the preferred embodiment of the invention.

DESCRIPTION OF THE PREFERRED EMBODIMENT

Figure 1:
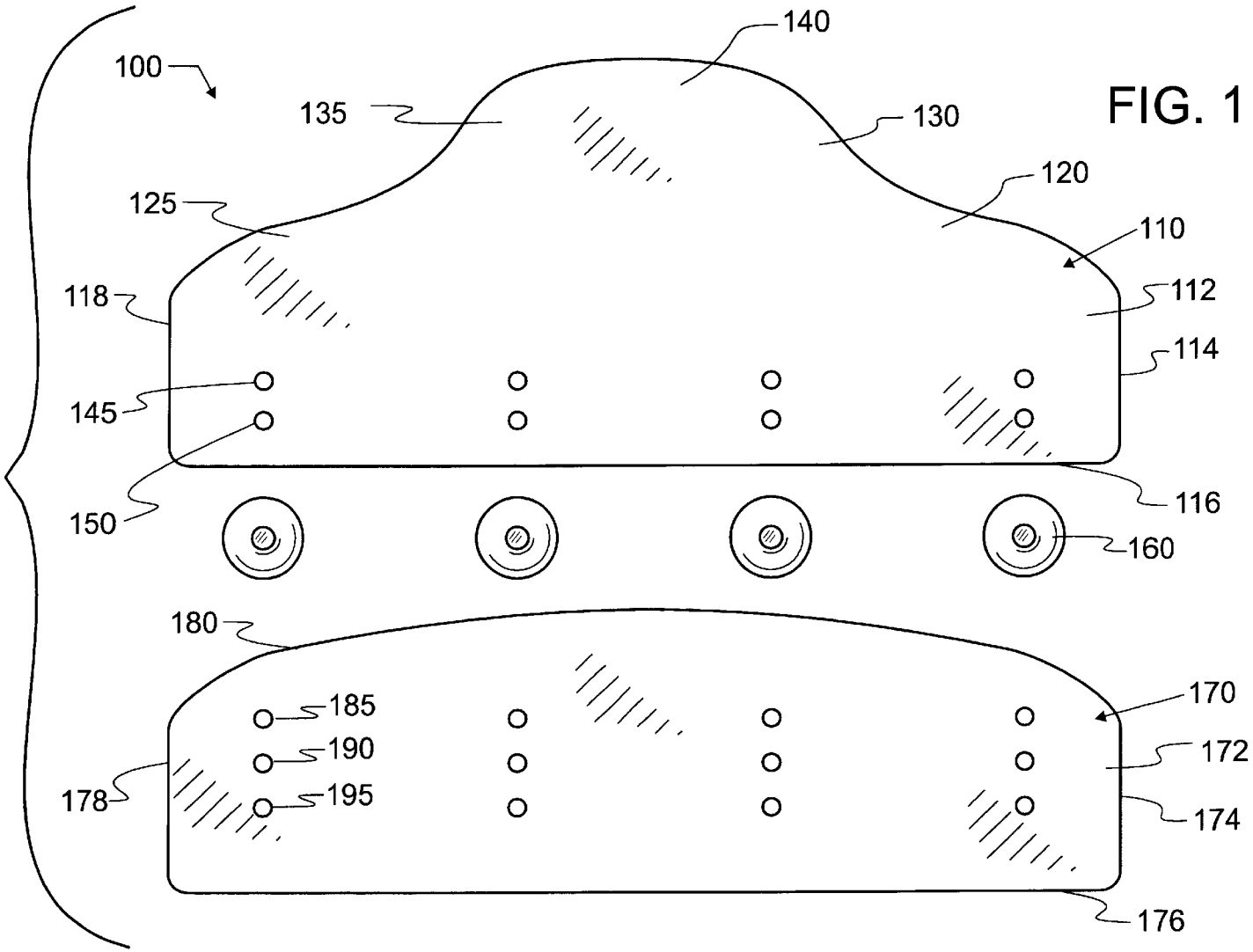
FIG. 1 illustrates a plan view of a preferred embodiment splash guard and extension designed in accord with the teachings of the present invention, shown laid flat.

FIG. 1 illustrates the preferred embodiment splash guard 100 in separate, disassembled sections laid flat for illustrative purposes. Splash guard 100 includes a top guard sheet 110 having a base surface 112 which forms a generally rectangular region having sides 114, 118 and base 116 extending therebetween. A top bib portion 140 is provided centrally along the top of rectangular base 112, and is provided with downwardly sloping surfaces 130,135 extending therefrom. Armrests are provided with gentler sloping portions 120, 125 that eventually terminate at edges 114 and 118. Holes 145, 150 are provided in base surface 112, the function which will be explained in greater detail in reference to FIG. 2.

An extension 170 is also provided in the most preferred embodiment, having a generally rectangular region 172 similar to region 112 of top guard sheet 110, and having like edges 174, 178, base 176 and top 180. In the most preferred embodiment, extension 170 further has three vertically aligned holes 185, 190 and 195. As illustrated, extension 170 is dimensionally similar to base surface 112, which is most preferred for structural reasons, but not essential to the invention.

Top guard sheet 110 and extension 170 may be manufactured from a variety of different materials and geometries, the exact nature which are not critical to the invention. However, most preferably splash guard 100 will be constructed from materials that offer sufficient rigidity to be self-supporting and to be able to support the continuous load of a person's arms during normal dishwashing and working in and about a sink or basin. Most ideally, the materials will not only support a person's arms, but also offer sufficient rigidity to help the person with balance and posture during an extended period working at a sink. Furthermore, the most preferred material will offer significant chemical resistance and water shedding, to prevent the accumulation of deposits thereon or stains and other unsightly appearances. A most preferred material is that commonly found in waste paper baskets, garbage cans and other similar applications, which require a similar degree of chemical and stain resistance, and structural integrity. As may be apparent from the illustrations, the invention may be manufactured from sheet stock, or as will be discussed herein below with reference to FIG. 3, the invention may alternatively be molded. Lower costs of manufacture are attainable using flat sheet stock, and volumes of production for a particular design may be substantially lower without the tooling costs associated with molding. Nevertheless, and again as referenced with FIG. 3, there are also benefits that may be attained with injection, rotational or similar molding processes.

Figure 2:
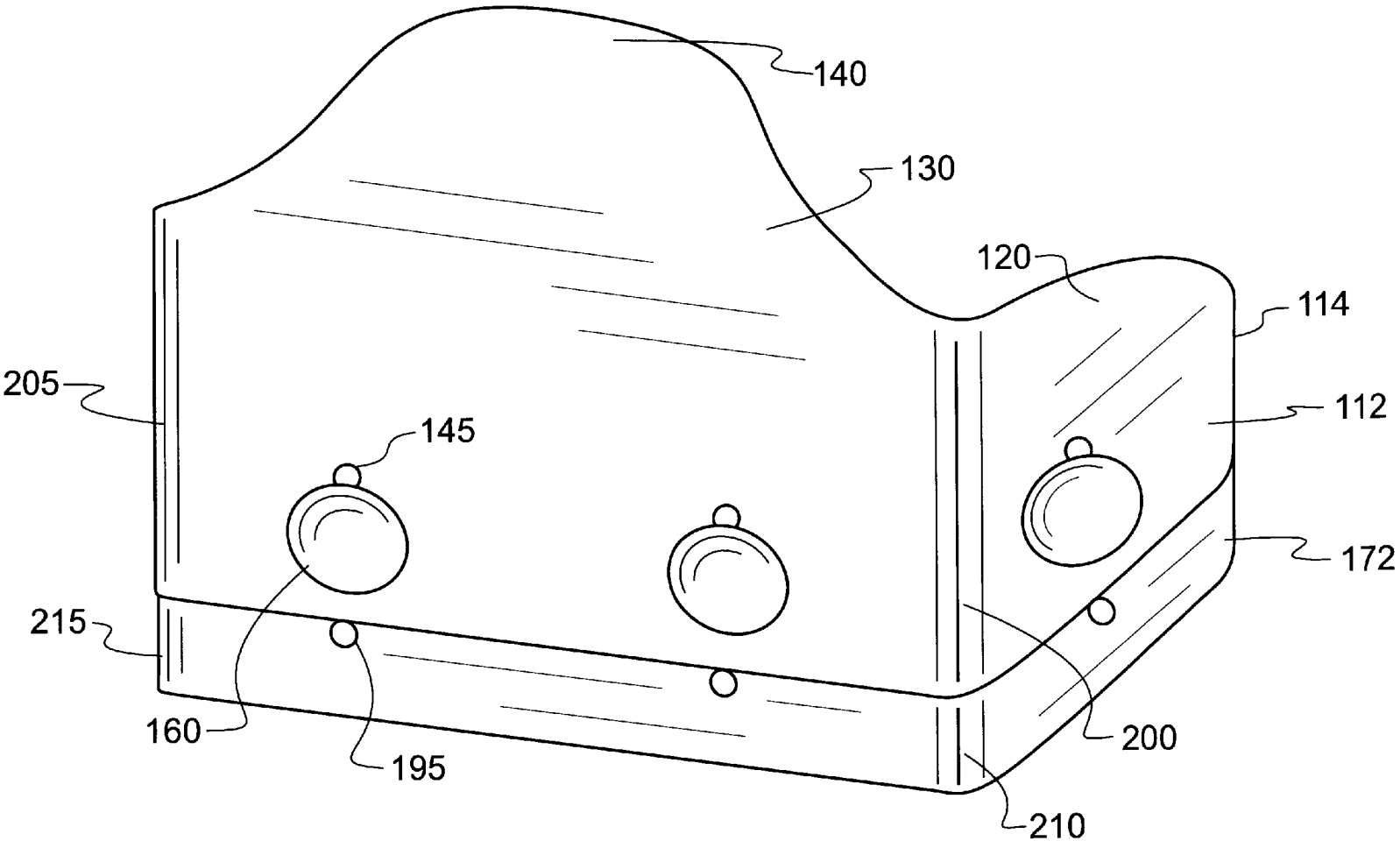
FIG. 2 illustrates the preferred embodiment splash guard and extension in combination from a projected view, as the splash guard might appear prior to insertion in a rectangular sink or wash basin.

FIG. 2 illustrates splash guard 100 from a projected view, showing fold lines 200, 205 in base 112 and also fold lines 210, 215 in extension surface 172. Fold lines 200–215 may be generated as a consequence of the user pressing splash guard 100 into a sink, or may alternatively be formed by another operation, such as a thermofolding or thermoforming operation. Particularly where a thermoforming operation is used, it may be highly desirable to add a slope or cup shape to top bib portion 140, to redirect splashes or waves within a sink or basin back into the basin. As noted, this can be done by sloping top bib portion 140 so that the top thereof leans towards the center of the sink. Alternatively, top bib portion 140 may be slightly cupped about a radius offset towards the center of the sink, thereby making bib 140 shaped more nearly like a spoon with the concave side facing the liquid.

As can be seen in FIG. 2, most preferably extension surface 172 nests inside of base 112. This arrangement provides better retention between top guard sheet 110 and extension 170. However, in some applications it may be desirable to place extension 170 outside of top guard sheet 110, and this arrangement is also contemplated herein. Top guard sheet 110 and extension 170 are retained together by suction cups 160 that pass through holes 150 and into holes 185, as shown in FIG. 2. Suction cups 160 are most preferably manufactured from relatively soft and pliable vinyl, and are commercially available with a small bulb or protrusion that enables them to retain guard sheet and extension 170 together, even when moderate forces are applied tending to separate the two. However, in the event the two are to be separated or readjusted, suction cups 160 may be readily removed therefrom without disrupting or damaging any of the components of splash guard 100. Readjustment may be achieved by removing suction cups 160 from ones of holes 145, 150 and holes 185, 190, 195 and repositioning into other holes as desired. In this way, the total vertical height between bottom edge 176 of extension 170 and top bib portion 140 is variable. While in the most preferred embodiment two vertically displaced holes 145, 150 are illustrated and three bottom holes 185–195, any number of various hole combinations may be provided. Furthermore, while suction cups are most preferred due to cost, appearance, availability, and the dual functions of holding guard sheet 110 and extension 170 together and also of holding splash guard 100 in place within a sink or basin, other fasteners may be substituted for either or both of the dual functions. Any known suitable fastener may be selected that will perform the requisite function, including buttons, removable or more permanent adhesives, Velcro and other such devices.

Figure 3:
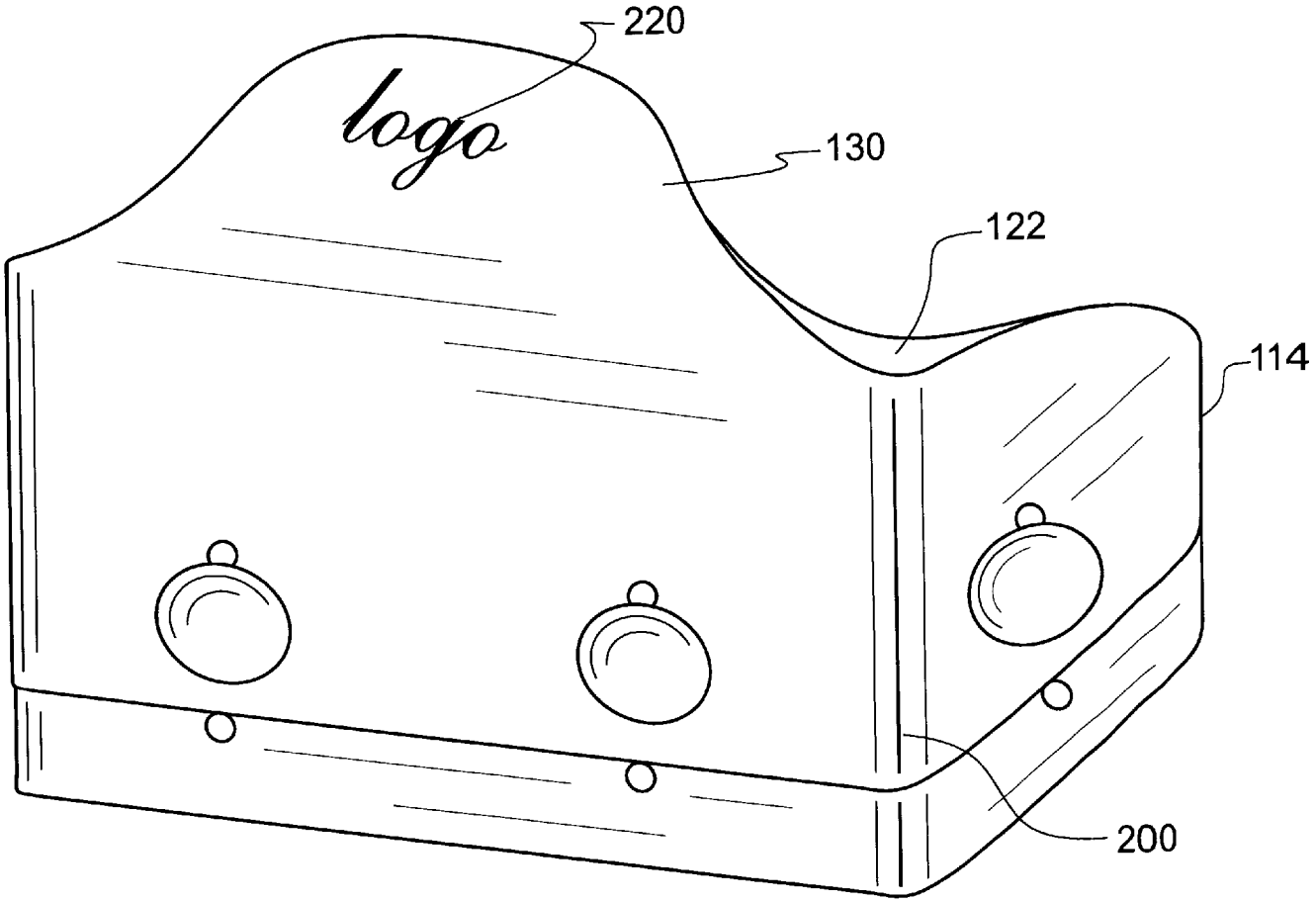
FIG. 3 illustrates an alternative embodiment splash guard and extension in combination from a projected view, having molded or shaped arm rests.

FIG. 3 illustrates an alternative embodiment splash guard that serves to illustrate one of many contemplated alternatives that can be designed to serve the needs of a particular application, provided alternative manufacturing techniques are acceptable for the costs and demands of the application. As can be seen therein, armrest 120 may be replaced or augmented by the provision of an enlarged, formed armrest 122. The armrest will still most preferably be provided adjacent fold region 200, generally between right-hand downwardly sloping surface 130 and right edge 114. However, the larger edge will be most beneficial in those situations where comfort is of more paramount importance. While edge 120 has been found to provide suitable support for many applications such as ordinary dishwashing, the edge may become bothersome in commercial applications where a person will be resting their arms for extended periods, owing to the relatively small surface area of the edge. Where molding of the splash guard 100 is a viable option, arm rest 122 may be simply molded into the structure, thereby providing a smooth and comfortable contour.

Arm rest 122 may also be formed out of the same sheet stock as the remainder of splash guard 100 in the preferred embodiment, and be simply folded over from an extension of arm rest 120 towards downwardly sloping surface 130 or from downwardly sloping surface 130 towards arm rest 120, as may be appropriate. Furthermore, armrest 122 may be manufactured by affixing a foam rubber pad, gel packs or other suitable material to contour 120 or downwardly sloping surface 130 to provide a desired degree of cushioning. FIG. 3 also illustrates one preferred placement for advertising logo 220, which provides high visibility and excellent association with top bib portion 140.

While the foregoing details what is felt to be the preferred embodiment of the invention, no material limitations to the scope of the claimed invention are intended. Further, features and design alternatives that would be obvious to one of ordinary skill in the art are considered to be incorporated herein. For example, the use of extension 170 is most preferred, but the use of top guard sheet 110 without extension 170 is contemplated herein, and the selection of appropriate thickness for top guard sheet 110 and selection of appropriate geometry for suction cups 160 will be required. Various other alternatives have been presented herein above. Therefore, the scope of the invention is set forth and particularly described in the claims hereinbelow.

I claim:

1. A device for increasing the vertical extension of receptacle walls to better shield a person's torso from exposure to materials within said receptacle, and about which said person may reach an arm to comfortably work for extended periods of time without the usually associated strain and fatigue, comprising:

a central elevated bib which acts as a shield for said torso by extending vertically beyond said receptacle walls between said torso and said receptacle;

a side lower than said central elevated bib above which said person may reach while maintaining said bib between said torso and said receptacle, thereby allowing said person to reach around said central elevated bib into said receptacle, said central elevated bib and said sides further defined by a lower edge;

an extension which may be extended from at least one of said central elevated bib and said sides in a downward direction, to thereby displace said central elevated bib and said sides vertically upward within said receptacle; and an armrest for supporting said arm above said side and around said central elevated bib.

2. The vertical extension device of claim 1 wherein said device is further comprised by a formed sheet stock material, and said armrest is comprised by the thickness edge of said sheet stock shaped in a gentle, substantially horizontal curve.

3. The vertical extension device of claim 1 wherein said armrest is comprised by a surface extending substantially perpendicular to said central elevated bib and generally parallel to the ground.

4. The vertical extension device of claim 1 further comprising a means for operatively adhering said device to said receptacle.

5. The vertical extension device of claim 1 wherein said extension further comprises a formed sheet material which is operatively interconnected to said at least one of said central elevated bib and said sides through a removable fastener.

6. The vertical extension device of claim 5 wherein said removable fastener further comprises a suction cup passing through ones of an assortment of holes formed in at least one of said extension and said at least one of said central elevated bib and said sides.

7. The vertical extension device of claim 1 further comprising an advertising logo carried upon said central elevated bib.

8. The vertical extension device of claim 1 wherein said central elevated bib further comprises a polymeric, chemical and stain resistant composition.

9. The vertical extension device of claim 1 wherein said central elevated bib and said side are within perpendicular planes, thereby providing self-support within said receptacle.

10. An adjustable apparatus for elevating an edge of a sink, basin or the like and thereby assisting with the retention of liquids and other materials therein, comprising:

a splash guard having an top edge defining an apron elevated above said sink edge and a surface extending downward therefrom to a base;

an extension for engaging said sink and extending in an vertical direction therefrom; and a suction cup adjustably engaging both said guard and said extension and retaining them adjacently, while varying an elevation of said base relative to said sink.

11. The adjustable apparatus of claim 10 wherein said splash guard and said extension further comprise resilient planar stock which is self-supporting and load bearing in a direction parallel to a plane of said planar stock, said planar stock further comprising a chemical and stain resistant composition.

12. The adjustable apparatus of claim 11 wherein said planar sheet stock may be manually bent into the shape of diversely dimensioned basins, whereby said adjustable apparatus may be used in combination with a wide variety of said sinks, basins or the like.

13. The adjustable apparatus of claim 10 further comprising a plurality of holes extending through one of said splash guard and said extension and one hole extending through the other of said splash guard and said extension, wherein said suction cup may pass through said one hole and a one of said plurality of holes, whereby, depending upon the selection of said one of said plurality of holes, said extension may be adjustably positioned relative to said splash guard.

14. The adjustable apparatus of claim 10 further comprising an advertising logo displayed by said apron.

15. A splash guard formed from a polymeric sheet or the like for wrapping inside the vertical wall about a basin and extending vertically therefrom, comprising:

a generally rectangular, planar base having a bottom, two side walls and a top, and a central region along said top between said two side walls;

a planar tab adjacent said base top and forming a raised portion from said central region of said base vertically;

a left downward slope on a left side of said central raised tab sloping downwards away from said central raised tab;

a right downward slope on a right side of said central raised tab sloping downwards away from said central raised tab;

a left armrest adjacent said left downward slope and one of said two base sidewalls and also distal from said central raised tab;

a right armrest adjacent said right downward slope and one of said two base sidewalls and also distal from said central raised tab;

wherein said base, said central raised tab, said right and left downward slopes, and said right and left armrests may be wrapped inside said basin vertical wall to form a three-dimensional structure, thereby enhancing a retention of materials within said basin while simultaneously providing a human armrest.

16. The splash guard of claim 15 further comprising:

a first fastening means affixed to said polymeric sheet;

an extender having a second fastening means affixed thereto for removably and adjustably fastening to said first fastening means;

whereby said extender may be removably attached to said polymeric sheet and adjusted relative thereto, to vary the amount of extension provided by said extender.

17. The splash guard of claim 15 wherein said armrest further comprises a formed polymeric material shaped to smoothly support and accommodate an arm.

* * * * *